United States Patent [19]

Elias et al.

[11] 4,384,451

[45] May 24, 1983

[54] METHOD OF AN APPARATUS FOR SPINNING-IN YARN IN OPEN-END SPINNING UNITS

[75] Inventors: Jiri Elias, Brandys nad Orlici; Karel Mikulecky, Chocen; Frantisek Burysek, Usti nad Orlici; Jan Janousek, Brandys nad Orlici; Stanislav Esner, Usti nad Orlici, all of Czechoslovakia

[73] Assignee: Vyzkumny ustav bavlnarsky, Usti nad Orlici, Czechoslovakia

[21] Appl. No.: 231,412

[22] Filed: Feb. 4, 1981

[30] Foreign Application Priority Data

Feb. 15, 1980 [CS] Czechoslovakia ..... 1071-80

[51] Int. Cl.[3] ..... D01H 15/00

[52] U.S. Cl. ..... 57/263; 57/301; 57/415

[58] Field of Search ..... 57/263, 301, 415

[56] References Cited

U.S. PATENT DOCUMENTS

| | | | |
|---|---|---|---|
| 4,020,622 | 5/1977 | Lattion | 57/263 |
| 4,022,011 | 5/1977 | Hirai | 57/263 |
| 4,059,946 | 11/1977 | Böttcher | 57/263 |
| 4,089,155 | 5/1978 | Stahlecker | 57/263 |
| 4,222,225 | 9/1980 | Stahlecker | 57/415 X |

*Primary Examiner*—Donald Watkins

[57] ABSTRACT

Improved yarn spinning-in process and apparatus in open-end rotor spinning units which raises the quality of the spun-in point in the yarn to a level comparable with the quality of the entire yarn length. The yarn open end is pieced on to high-quality fibers while low-grade fibers are separated from the high-quality fibers and do not participate in the spinning-in process.

7 Claims, 5 Drawing Figures

METHOD OF AN APPARATUS FOR SPINNING-IN YARN IN OPEN-END SPINNING UNITS

The invention relates, on the one hand, to a method of spinning-in yarn in an open-end spinning unit having a spinning rotor which is preceded by a fiber separating device having a sliver feeding device and a fiber separating cylinder, wherein yarn by the action of spinning-in means is returned into the spinning rotor to be pieced on to a fibrous ribbon produced in a collecting channel of the spinning rotor, by restarting the sliver feeding device which has been set out of operation in the previous phase. The yarn pieced on to the ribbon is then again withdrawn from the spinning rotor, the spinning-in step being started after the spinning rotor has been cleaned. The invention also relates to an apparatus for carrying out the above-described method in an open-end spinning unit having a spinning rotor communicating via a fiber conveying duct with a fiber separating device comprising a feed roller and a fiber separating cylinder, the apparatus being provided with spinning-in means adapted to return the yarn end into the spinning rotor to be spun-in.

Open-end rotor spinning machines are usually equipped with means for automatically spinning-in yarn in the case of a yarn breakage, or upon restarting the machine. The spinning-in process is substantially based upon the return of the yarn end into the spinning rotor.

In the constant endeavor to raise the productivity of the OE rotor spinning process by increasing the rotor speed, the problem of the quality of the spun-in points in the final yarn product must be coped with.

With spinning units wherein fibers are separated by a high-speed separating cylinder and wherein, in the case of a yarn breakage, the sliver delivery by the feeding means of the fiber separating device is interrupted, the spun-in point quality is negatively influenced by the fact that a fiber beard which is held by the stopped feeding means is strongly attacked by the separating cylinder clothing. Such an attack results in the considerable damaging and shortening of the fibers in the leading, beard-forming sliver end, which in turn has a negative influence on the quality parameters of the spun-in or pieced point.

Some solutions of the afore-mentioned problem have been known.

According to one of them, the yarn delivery, in case of a breakage, together with the sliver feeding device and the separating cylinder are stopped. However, the cylinder, due to its weight, high speed and inertia, cannot come to a stand-still immediately, so that during its run-out and start, a certain fiber degradation occurs.

In accordance with another principle of solution disclosed, for example, in the Czechoslovak Patent Specification No. 140,957, the leading sliver end is retracted from the reach of the separating cylinder after the feeding means has been stopped. However, when the beard again approaches the rotating cylinder, the fibers are abruptly attacked by the cylinder clothing so that the problem of fiber damaging and shortening is only partially prevented.

According to another known solution, a baffle means is inserted between the rotating separating cylinder and the fiber beard, which baffle is to prevent the beard from being damaged by the cylinder clothing. A disadvantage of this measure consists in that after the beard has been re-exposed, the cylinder clothing teeth abruptly enter the fibrous material and tear off fiber tufts therefrom. These tufts thus impair the spun-in point quality since such a point contains a considerable nep proportion; a decrease in fiber mass, due to the missing fiber tufts in the leading sliver end, makes a short yarn length immediately downstream the piecing point thinner. Such a critical yarn length obviously constitutes a source of faults in further mechanical yarn processing. Thus the negative effects of the above measure can be characterized as an abrupt attack by the cylinder clothing and an unstable start of the separating process, which results in the delivery of fiber tufts and neps on start of spinning-in process.

A common disadvantage of prior art consists in that the fiber damaging in the end portion of the fiber bundle is only mitigated, which means that it cannot be completely removed. It is true that the fiber beard is not attacked so intensively as before but, all the same, a damage to which the beard is exposed to manifests itself still in the quality of spun-in points as well as in the yarn structure immediately downstream said point. The defective spun-in point which is then estimated by objective methods as a fault in yarn negatively influences further yarn processing.

The spinning-in process is carried out, as a rule, after the spinning rotor has been freed manually or mechanically of yarn remainders, dust and impurities. On the starting of the spinning rotor, especially in high-speed machines, the fibers are combed out of the beard without the fiber supply having yet been set in operation while fibers are conveyed into the collecting channel of the spinning rotor. Such low-grade fibers undesirably fill up said channel before the actual spinning-in process has been initiated. This phenomenon, which is particularly marked when spinning fine yarn types, substantially reduces the ability of yarn to be spun-in. But even in the production of coarser yarn types, where the ability of yarn to be spun-in is not influenced by the premature filling of the collecting channel, the quality of spun-in points is reduced to some extent.

It is an object of the present invention to improve the method of spinning-in yarn in open-end rotor spinning units so as to raise the quality of the spun-in points in the yarn to a level comparable with the quality of the entire fiber length.

Another object of the invention is to provide a simple and operatively reliable apparatus for performing the above method.

These objects are substantially achieved by the yarn spinning-in method according to the invention. In such method fibers contained in a fiber beard at the leading end of the sliver clamped in the feeding device are removed from the spinning-in process by leading them away from the fiber transport path between the feeding device and the spinning rotor.

Damaged fibers are excluded from the spinning-in process immediately before the initiation of this process, after ending all the preparatory steps therefor and after cleaning and during the starting of the spinning rotor. The fiber separating cylinder need not be stopped in the spinning-in process since the damaged fibers are led away by themselves in the spinning-in process outside the spinning rotor. Thus the cylinder actuating elements are not exposed to any wear.

The apparatus according to the invention for carrying out the method is characterized by having a means for leading fibers away from the fiber transport path between the feeding device and the spinning rotor during the spinning-in process.

In accordance with a preferred feature of the apparatus, the fiber leading-away means comprises, on the one hand, a vacuum duct opening in a front wall of substantially a cylindrical recess for the fiber separating cylinder, said recess being provided in the housing of the fiber separating device, and, on the other hand, pneumatic means for the negation of a vacuum effect in the fiber conveying duct during the spinning-in process.

The mouth of the vacuum duct is preferably provided either downstream or upstream of the inlet of the fiber conveying duct relative to the fiber flow from the sliver feeding device to said duct, or, alternatively, in any other suitable region of the wall of cylindrical recess for the fiber separating cylinder between the feeding device and the straight duct.

When using a spinning rotor the front opening of which is engaged, in the operative rotor position, by a stationary fiber separator which is carried by the housing of the fiber separating device and in which the fiber conveying duct opens, the axis of said duct pointing towards the inner wall of the separator, it is preferable that the pneumatic means comprise a nozzle which is provided in the housing of the separator and which has a mouth opening in the inner front wall of the separator and pointing toward the outlet of the fiber conveying duct, the nozzle being controlled by a control unit in dependence upon the phases of the spinning-in process.

In order that the invention may be better understood and carried into practice, some preferred embodiments thereof will be hereinafter described with reference to the accompanying schematic drawings, in which.

Figure 1:
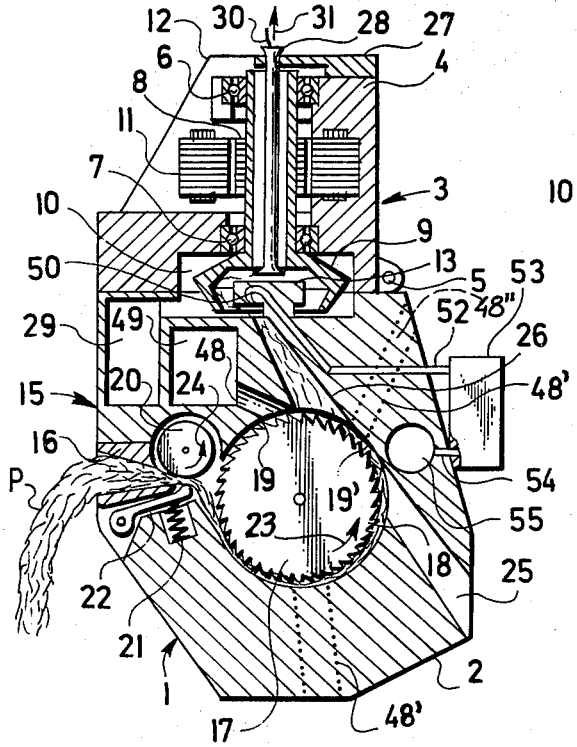
FIG. 1 shows a spinning unit without a take-off and a winding device in a vertical sectional view along the rotational axis of the spinning rotor.
Figure 2:
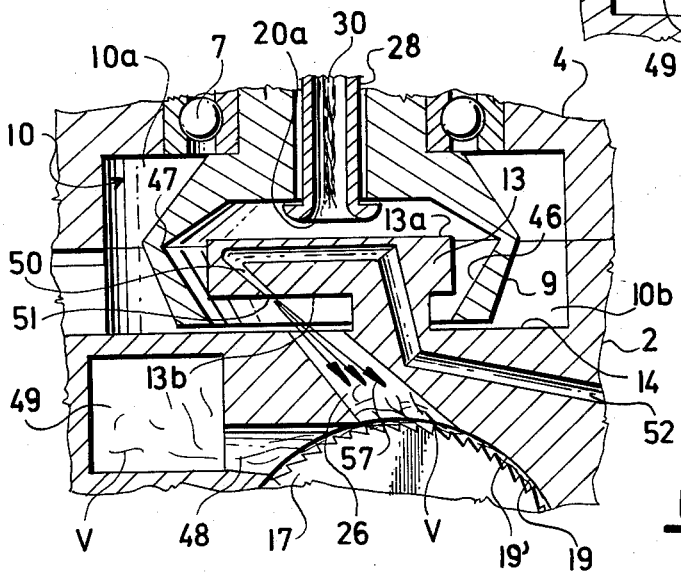
FIG. 2 is an enlarged detailed sectional view of the spinning rotor region of the apparatus.

As can be seen in FIG. 1, the spinning unit there shown comprises a fiber separating device 1 received in a stationary housing 2, and a yarn twisting device 3 received in a housing 4 which is tiltable about a pivot 5 secured to the housing 2 (see also FIG. 2).

Supported by bearings 6, 7 in the housing 4 of the yarn twisting device 3 is a rotor 8 which is embodied as the hollow shaft of a spinning rotor 9 housed in the chamber 10 formed by two recesses 10*a*, 10*b* (FIG. 2) provided in the two facing walls of the housings 2, 4, respectively, when the latter bear upon each other. The rotor 8 is a part of a high-frequency electric motor the stator 11 of which is fixed in the housing 4 of the yarn twisting device 3. The mechanism of the device 3 is masked by a hood 12. The cavity of the spinning rotor 9 is engaged by a separator 13 projecting from the bottom 14 of the recess 10*b* in the housing 2. The separator 13 has an outer front wall 13*a* and an inner front wall 13*b*.

The fiber separating device 1 comprises a sliver feeding device 15 which is preceded by a condenser 16, and a separating cylinder 17 with combing elements 18, the cylinder being received in a substantially cylindrical recess 19 provided in the housing 2.

The feeding device 15 designed for supplying a sliver P to the separating cylinder 17 comprises a feed roller 20 toward which a presser shoe 22 is forced by a spring 21. The drive of the fiber separating cylinder 17 in the direction of arrow 23 and that of the feed roller 20 in the direction of arrow 24 are effected via known gear means (not shown) from the spinning unit drive motor, the feed roller 20 being driven via electro-magnetic coupling as hereinafter referred to.

In the housing of the separating device 1 there is provided a straight duct 25 which extends tangentially relative to the separating cylinder 17. The duct 25 connects the ambient atmosphere with the interior of the spinning rotor 9 and opens in the bottom 14 of the recess 10*b* in the housing 2 to face the inner front wall 13*b* of the separator 13. That part of the straight duct 25 extending downstream of the separating cylinder 17 assumes the function of the fiber conveying duct 26 for supplying separated fibers to the spinning rotor 9.

A holder 27 secured to the top of housing 4 carries a yarn take-off tube 28 which enters the interior of the spinning rotor 9 by its flared intake end portion 20*a* (FIG. 2). The chamber 10 communicates with a withdrawing conduit 29 common for an array of spinning units in the machine, the conduit 29 being connected to a subatmospheric pressure source (not shown). A technological subatmospheric pressure in the spinning rotor 9 which manifests itself as a vacuum effect in the yarn take-off tube 28 and in the straight duct 25 can be alternatively produced by rotation of the spinning rotor 9 which functions in this case as a fan.

In the block diagram (FIG. 3) of the spinning unit, yarn 30 spun out in the spinning rotor 9 and withdrawn in the direction of arrow 31 by take-off rollers 32, 33 through the take-off tube 28 is wound by means of a traversing mechanism 34 onto a bobbin 35 which is set in rotation by a drive roll 36 and which is supported in a pivotable bobbin holder 37. Since a usual winding mechanism of open-end spinning machines is concerned here, it need not be described in detail.

The spinning unit is further provided with spinning-in means 38 for remedying a thread breakage which can arise in normal spinning operation or by switching-off of the spinning unit. The object of the spinning-in means—if the breakage has arisen in the normal spinning process—is to stop the run of the broken yarn so as to cause its end to stay in the take-off tube 28 in the vacuum region as well as to reverse the yarn take-off, which means to return a predetermined yarn length back into the spinning rotor to be pieced onto a fresh fibrous ribbon which has just been built in the collecting channel of the spinning rotor, and to restart both the yarn take take-off and the spinning process.

As the spinning-in means the spinning-in device disclosed, for example, in the German DE-AS No. 1,510,986 can be used.

In an exemplary embodiment, the drive roll 36 is coupled with the drive via a reverse clutch (not shown) by which it can be stopped, given the return motion, and given the normal forward motion. As known, e.g. in the machinery industry, such a reverse clutch comprises two electromagnetic clutches which are designed with clutch members which alternately engage the drive means so as to retate in opposite directions; by engaging one clutch member with the drive means the yarn is withdrawn, by engaging the other clutch member with the drive means the yarn is returned; and by disengaging the two clutch members from the drive means the yarn take-off is stopped.

The drive of the take-off roller 33 from the drive roll 36 is effected, by way of example, by a timing belt 39.

The sequence of the operation of the individual work elements of the spinning unit is cared for by a control unit 40 connected via line 41 with the spinning-in means 38, via line 42 with a thread breakage detector 43 supported on a frame (not shown) between the housing 4 of the yarn twisting device 3 and the take-off rollers 32, 33, via line 44 with the not shown high-frequency electric motor 8, 11 (FIG. 1) of the spinning rotor 9, and via line 45 with the above-described electromagnetic clutches (not shown) interposed between the drive of the feed roller 20 (see e.g. German DE-OS No. 2,018,801), and via line 56 with an electromagnetic pneumatic valve 53.

As control unit 40 the device described in the German DE-OS No. 2,413,632 can be used.

Fibers combed out by the separating cylinder 17 from the sliver P supplied by the feeding device 15 are conveyed through the duct 26 over the inner front wall **13*b* of the separator 13 and the sliding wall 46 of the spinning rotor 9 into its collecting channel 47 in the rotor where a fibrous ribbon is produced. The ribbon is twisted in the known manner to form yarn 30 which is withdrawn by the take-off rollers 32, 33 and finally wound onto the bobbin 35**.

According to the invention, the spinning unit is provided with means for leading the fibers away from the transport path between the feeding device 15 and the spinning rotor 9.

This means is embodied, for instance, on the one hand, by a vacuum duct 48 opening in the wall 19' of the cylindrical recess 19 in the housing 2 immediately downstream of the inlet of the fiber conveying duct 26, and, on the other hand, by pneumatic means for the negation of a vacuum effect in the duct 26 during the spinning-in process.

The vacuum duct 48 communicates with a common collecting duct 49 of a plurality of spinning units, the duct 49 being connected to a source of subatmospheric pressure of a lower value than that produced in the spinning rotor 9.

Figure 3:
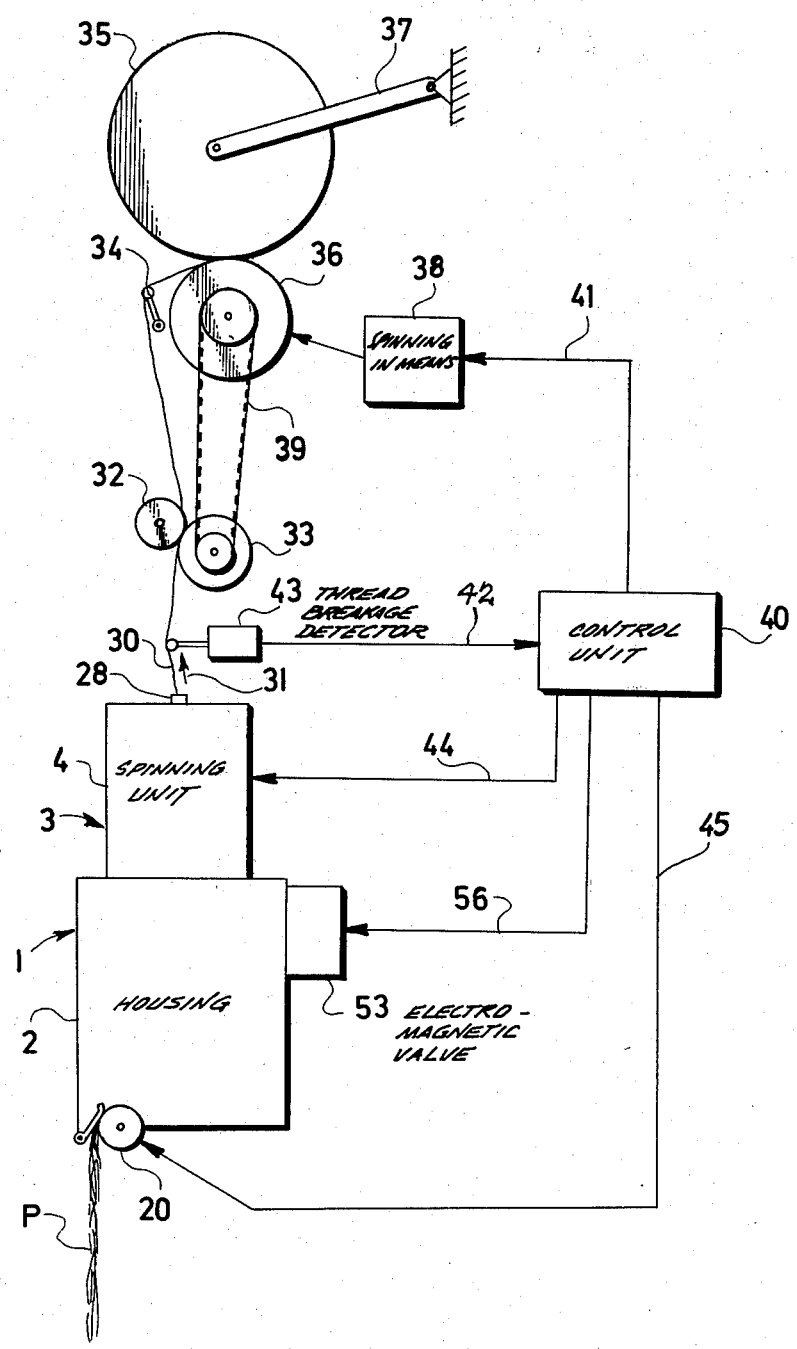
FIG. 3 is a block diagram of the spinning unit.

The pneumatic means comprises a nozzle 50 having a mouth 51 which is provided in the inner front wall **13*b* of the separator 13 and faces the outlet of the fiber conveying duct 26. The nozzle 50 communicates through a duct 52 in the separator 13 and in the housing 2, and via an electromagnetic valve 53 and piping 54 with a through piping 55 for a plurality of spinning units, said piping 55 being connected to a not shown superatmospheric pressure source (FIGS. 1, 2). The electromagnetic valve 53 is connected via line 56 to the control unit 40 (FIG. 3**).

In operation, a thread breakage is indicated by a decrease in the spinning tension of the yarn. The thread breakage detector 43 releases a signal to the control unit 40 which sets in operation the spinning-in device 38, the electromagnetic clutches of the feed roller 20 and switches off the power supply to the motor 8, 11 of the spinning rotor 9. The electromagnetic clutches stop the rotation of the feed roller 20 whereby the fiber supply to the separating cylinder 17 is interrupted, and the spinning-in device 39 reverses, via reverse clutch, for a while the rotation of the drive roll 36 and of the take-off rollers 32, 33 so that the end of broken yarn 30 remains in the take-off tube 28. As apparent from FIG. 3, the drive roll 36 simultaneously with the yarn run reverses the rotation of the bobbin 35.

After the spinning rotor 9 has come to a stand-still, the operator tilts off the housing 4 and cleans the collecting channel 47 of the spinning rotor 9 from remainders of yarn, fibers and impurities, whereupon he gives the yarn end a shape and a length suitable to be spun-in. The aforesaid two manual steps can also preferably be carried out automatically by known means.

The actual spinning-in process commences by the start of spinning rotor 9. The control unit 40 switches on the power supply to the motor 8, 11 of the spinning rotor 9 and simultaneously, or immediately thereafter, to the electromagnetic valve 53.

Such a sequence of steps prevents a low-grade fibrous ribbon from being produced in the collecting channel of the spinning rotor from fibers combed out by the separating cylinder 17 from the fiber beard held by the inoperative feeding device 15 at the instant when the forward feeding electromagnetic clutch of the feed roller 20 has not yet been engaged. After a short time interval, viz. after the spinning rotor has reached its operation speed rate, the control unit 40 switches on the forward feeding electromagnetic clutch of the feed roller 20 which restores the fiber supply to the separating cylinder 17. The actuated electromagnetic valve 53 admits pressurized air into the nozzle 50. By air flow 57 (FIG. 2) directed to the outlet of the conveying duct 26 an "air plug" is produced in said duct. Such a plug prevents the separated fibers V previously combed out from the fiber beard and on the starting of the feed roller 20 (the so-called fiber remainder) which fly off the surface of the separating cylinder 17 from entering the conveying duct 26 so that the fibers V are led away through the vacuum duct 48 into the common piping 55 (FIG. 2).

This is why the collecting channel 47 of the spinning rotor 19 is not supplied with damaged or low-grade fibrous material comprising, on the one hand, the fiber remainder and fibers combed out of the stationary fiber beard while the feed roller 20 is out of operation, and, on the other hand, fibers from a damaged beard after restoring the fiber feed by the feed roller. In both cases substantially shortened fibers of lower strength are concerned.

After a certain experimentally ascertained time interval which is necessary for leading away all of the damaged fibers from the beard and for establishing a stationary condition of the fiber separating device, which condition depends especially upon the kind and titre of the supplied sliver and on the type of the fiber separating cylinder, the pressure air intake into the nozzle 50 is again interrupted. Thus due to the effect of operative subatmospheric pressure prevailing in the spinning rotor 9 which pressure exceeds the undepressure effect in the mouth of the vacuum duct 48, the separated fibers V' follow their usual way through the conveying duct 26 and further on via separator 13 and sliding wall 46 until they reach the collecting channel 47 of the spinning rotor 9 which channel has been free of any fibrous material up to this instant.

Figure 4:
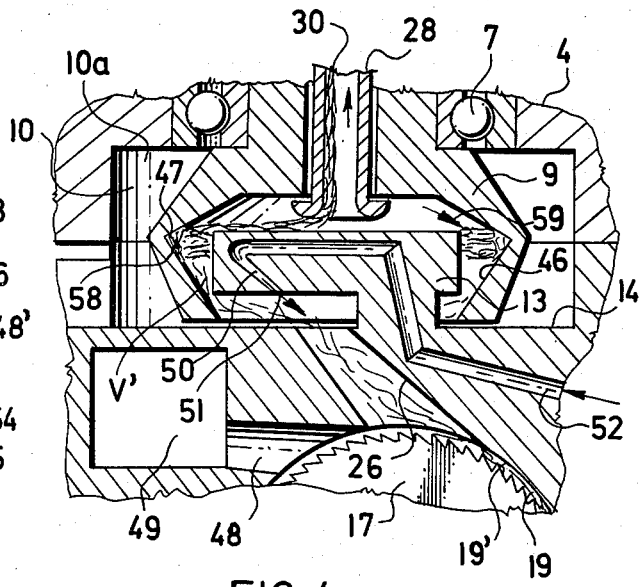
FIGS. 4 and 5 are enlarged detailed vertical sectional views of the spinning rotor region of the apparatus in different spinning-in process phases, respectively.

Simultaneously with the building of the fibrous ribbon 58 in the collecting channel 47, the phase of returning the yarn end located in the take-off tube 28 in the direction of arrow 59 (FIG. 4) to the collecting channel 47 commences by the reverse rotation of the winding device and the take-off rollers 32, 33 and under cooperation of a vacuum effect in said tube.

Figure 5:
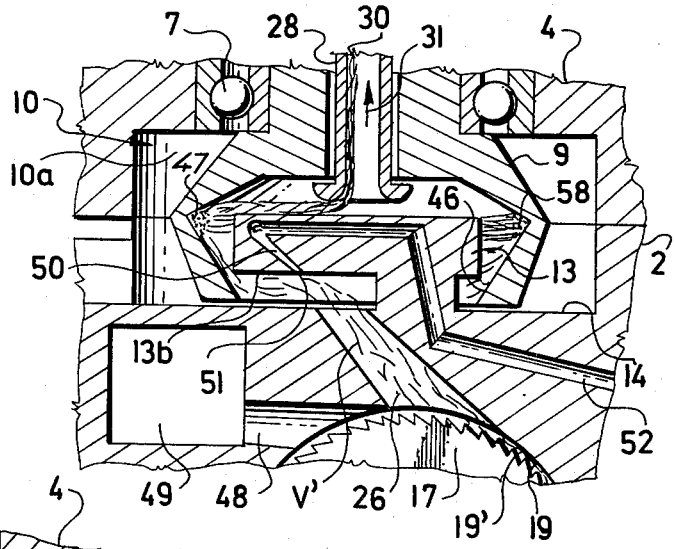

The fiber supply and the return of the yarn end back into the spinning rotor 9, i.e. the instant when the yarn return has been initiated and when the pressure air out-flow from the nozzle 50 has been cut off, is controlled so that the fibrous ribbon 58 at the instant of yarn ribbon contact may possess the correct weight corresponding to the count of the final yarn product. Immediately after the yarn end has contacted the ribbon 58 (FIG. 5), the tension in the yarn rises so that the thread breakage detector 43 sets both the take-off device and the take-up device, via control unit 40 and spinning-in device 38, in normal spinning operation, while yarn 30 is again withdrawn again from the spinning rotor 9 in the direction of arrow 31 and wound onto bobbin 35. The situation during the normal spinning process is shown in FIG. 1.

The spun-in point which results from the aforedescribed process has an appearance and mechanical characteristics that are comparable with those of the normal yarn product so that upon examination no yarn faults will normally be found.

To meet the object of the present invention it is possible, under the circumstances, to carry out the method even by means of other analogous apparatuses, since for anyone having an ordinary skill in the art it should not be difficult to solve the problem by using other means with the knowledge of the present invention. The common feature of all such apparatuses is to prevent, by using technical measures, damaged fibers from penetrating into the spinning rotor and from infiltrating the yarn.

Such apparatuses can be based, for example, upon a mechanical, pneumatic, or electromagnetic principle controlled by a short-termed introduction of superatmospheric air pressure into the chamber 10 of the spinning rotor 9 whereby its function of producing a subatmospheric pressure is annihilated. Another exemplary measure consists in that due to a controlled short-termed increase of suction effect in the vacuum duct 48 by connecting said duct to a corresponding subatmospheric air pressure source, such as an injector, the suction effect of the spinning rotor becomes negligible.

Likewise it is possible to connect the conveying duct 26 to the vacuum duct 48 via a mechanically or electromagnetically controllable valve, partition, shunt, or the like (not shown).

The correct operation of the apparatus does not depend upon a particular location of the vacuum duct 48 relative to the position of the fiber conveying duct 26. FIG. 1 shows, in dotted lines, an alternative 48' of the location of the vacuum duct 48. According to still another alternative, it is possible to use, for the taking-off of fibers unsuitable to be spun-in, a usual impurity separating aperture 48'' disposed in the region of the front wall 19' the cylindrical recess 19 for the fiber separating cylinder 17.

Although the invention is illustrated and described with reference to a plurality of preferred embodiments thereof, it is to be expressly understood that it is in no way limited to the disclosure of such preferred embodiments but is capable of numerous modifications within the scope of the appended claims.

We claim:

1. In a method of spinning-in yarn in an open-end spinning unit having a spinning rotor which is preceded by a fiber separating device having a sliver feeding device and a fiber separating cylinder, wherein yarn by the action of spinning-in means is returned into the spinning rotor to be pieced on to a fibrous ribbon produced in a collecting channel of the spinning rotor, by restarting the sliver feeding device which has been set out of operation in the previous phase, whereupon the yarn pieced on to the ribbon is again withdrawn from the spinning rotor, the spinning-in step being started after the spinning rotor has been cleaned, the improvement wherein short, low-quality fibers contained in a fiber beard at the leading end of the sliver clamped in the feeding device are removed from the sliver before the yarn end is subjected to the action of the spinning rotor in the spinning-in process by leading said short, low-quality fibers away from the fiber transport path between the feeding device and the spinning rotor.

2. An apparatus having an open-end spinning unit with a spinning rotor communicating via a fiber conveying duct with a fiber separating device comprising a feed roller and a fiber separating cylinder, the apparatus being provided with spinning-in means adapted to return the yarn end into the spinning rotor to be spun-in, the improvement wherein the apparatus comprises means for separating high-quality fibers from short, low-qualty fibers contained in a fiber beard at the leading end of the sliver clamped in the feeding device before the yarn end is subjected to the action of the spinning rotor durng the spinning-in process by leading the low-quality fibers away from the fiber transport path between the feeding device and the spinning rotor.

3. In a method of spinning-in yarn in an open-end spinning unit having a spinning rotor which is preceded by a fiber separating device having a sliver feeding device and a fiber separating cylinder, wherein yarn by the action of spinning-in means is returned into the spinning rotor to be pieced on to a fibrous ribbon produced in a collecting channel of the spinning rotor, by restarting the sliver feeding phase, whereupon the yarn pieced on to the ribbon is again withdrawn from the spinning rotor, the spinning-in step being started after the spinning rotor has been cleaned, the improvement wherein fibers which have been shortened in a fiber beard by the rotating separating cylinder after the feeding device has been switched off are removed at the beginning at the spinning-in step immediately after switching on the feeding device by leading them away from the fiber transport path before they have reached the spinning rotor.

4. In an apparatus having an open-end spinning unit with a spinning rotor communicating via a fiber conveying duct with a fiber separating device comprising a feed roller and a fiber separating cylinder, the apparatus being provided with spinning-in means adapted to return the yarn end into the spinning rotor to be spun-in, the improvement wherein the apparatus comprises means for separating high-quality fibers from low-quality fibers and for leading the low-quality fibers away from the fiber transport path between the feeding device and the spinning rotor during the spinning-in process, the low-quality fiber leading-away means comprising a vacuum duct opening in a front wall of substantially a cylindrical recess for the fiber separating cylinder, said recess being provided in the housing of the fiber separating device, and pneumatic means for the negation of a vacuum effect in the fiber conveying duct during the spinning-in process.

5. An apparatus as claimed in claim 4, wherein the mouth of the vacuum duct is provided downstream of the inlet of the fiber conveying duct relative to the fiber flow from the sliver feeding device to said duct.

6. An apparatus as claimed in claim 4, wherein the mouth of the vacuum duct is provided upstream of the fiber conveying duct relative to the fiber flow from the sliver feeding device to said duct.

7. In an apparatus as claimed in claim 4, wherein the spinning rotor has a front opening which is engaged in the rotor operative position by a stationary fiber separator which is carried by the housing of the fiber separating device and into which the fiber conveying duct opens, the axis of said duct pointing towards the inner wall of the separator, the improvement wherein the pneumatic means comprises a nozzle which is provided in the housing of the separator and which has a mouth opening into the inner front wall of the separator and pointing toward the outlet of the fiber conveying duct, the nozzle being adapted to be controlled by a control unit in dependence upon the phases of the spinning-in process.

* * * * *